US012342970B1

(12) United States Patent
Chen

(10) Patent No.: US 12,342,970 B1
(45) Date of Patent: Jul. 1, 2025

(54) BATHROOM STOOL

(71) Applicant: CHANGSHA ANXIANG MEDICAL TECHNOLOGY CO., LTD., Hunan (CN)

(72) Inventor: Junyuan Chen, Hunan (CN)

(73) Assignee: CHANGSHA ANXIANG MEDICAL TECHNOLOGY CO., LTD., Changsha (CN)

( * ) Notice: Subject to any disclaimer, the term of this patent is extended or adjusted under 35 U.S.C. 154(b) by 0 days.

(21) Appl. No.: 19/019,475

(22) Filed: Jan. 14, 2025

(30) Foreign Application Priority Data

Jul. 24, 2024 (CN) ..... 202421767043.8

(51) Int. Cl.

| | |
|---|---|
| ***A47K 3/28*** | (2006.01) |
| ***A47C 3/34*** | (2006.01) |
| ***A47C 3/40*** | (2006.01) |
| ***A47C 4/02*** | (2006.01) |
| ***A47C 5/10*** | (2006.01) |
| ***A47C 7/02*** | (2006.01) |
| ***A47C 7/42*** | (2006.01) |
| ***A47C 7/54*** | (2006.01) |
| ***A47C 7/62*** | (2006.01) |
| *A47B 9/14* | (2006.01) |
| *A47B 13/00* | (2006.01) |
| *A47B 13/02* | (2006.01) |
| *A47D 1/00* | (2006.01) |

(52) U.S. Cl.

CPC ..... *A47K 3/282* (2013.01); *A47C 3/34* (2013.01); *A47C 3/40* (2013.01); *A47C 4/02* (2013.01); *A47C 5/10* (2013.01); *A47C 7/0213* (2018.08); *A47C 7/42* (2013.01); *A47C 7/546* (2013.01); *A47C 7/624* (2018.08); *A47B 9/14* (2013.01); *A47B 13/003* (2013.01); *A47B 2013/022* (2013.01); *A47D 1/006* (2013.01); *A47D 1/008* (2013.01)

(58) Field of Classification Search

CPC .. A47K 3/282; A47C 3/34; A47C 3/40; A47C 4/02; A47C 5/10; A47C 7/0213; A47C 7/42; A47C 7/546; A47C 7/624; A47B 9/14; A47B 13/003; A47B 2013/022; A47D 1/006; A47D 1/008

USPC ..... 297/440.1, 440.14, 440.16, 440.21, 297/440.24, 461, 344.18, 411.23, 411.24, 297/411.26, 411.27; 108/147.19, 147.21, 108/156, 158.11, 159

See application file for complete search history.

(56) References Cited

U.S. PATENT DOCUMENTS 4,066,295 A * 1/1978 Severson ..... A47C 7/002 297/440.16

D267,211 S * 12/1982 Farrell ..... D6/352

(Continued)

*Primary Examiner* — Robert Canfield

(57) ABSTRACT

A bathroom stool includes a seat board, and a plurality of support legs. A plurality of first slots are defined in a bottom edge of the seat board, and a top end of each of the plurality of support legs is inserted into one first slot; a first engagement hole is defined in a side wall of the first slot; and a first through hole is defined in a side wall of the top end of the support leg, and a first compression elastic tab is disposed inside the support leg, a first protrusion being securely arranged on a side of the first compression elastic tab, the first protrusion extending, from the first through hole, out of the side wall of the support leg.

9 Claims, 14 Drawing Sheets

(56) References Cited

U.S. PATENT DOCUMENTS

| | | | | | |
|---|---|---|---|---|---|
| 4,852,837 | A * | 8/1989 | Merten | A47B 13/021 | 248/188 |
| 5,556,181 | A * | 9/1996 | Bertrand | A47B 9/00 | 108/14 |
| D566,409 | S * | 4/2008 | Lindqvist | D6/352 | |
| D833,765 | S * | 11/2018 | Mammi | D6/349 | |
| 10,722,046 | B1 * | 7/2020 | Poslowski | A47D 1/004 | |
| 11,202,518 | B1 * | 12/2021 | Lo | A47D 1/106 | |
| D1,055,543 | S * | 12/2024 | Yu | D6/349 | |
| D1,058,190 | S * | 1/2025 | Zhong | D6/333 | |
| 2004/0051365 | A1 * | 3/2004 | Darst | A47K 3/122 | 297/440.1 |
| 2008/0136244 | A1 * | 6/2008 | Cheng | A47C 7/546 | 297/411.26 |
| 2013/0099541 | A1 * | 4/2013 | Hung | A47C 9/002 | 297/344.21 |
| 2021/0401189 | A1 * | 12/2021 | Yang | A47D 1/004 | |
| 2022/0322889 | A1 * | 10/2022 | Ford | A47C 7/546 | |
| 2023/0055274 | A1 * | 2/2023 | Anokhin | A47D 1/004 | |
| 2023/0292931 | A1 * | 9/2023 | Andersen | A47D 1/0085 | 297/118 |
| 2025/0082100 | A1 * | 3/2025 | Chen | A47C 3/40 | |

* cited by examiner

BATHROOM STOOL

CROSS-REFERENCE TO RELATED APPLICATIONS

This application claims priority to Chinese Patent Application No. 202421767043.8, filed with the Chinese Patent Office on Jul. 24, 2024, titled "BATHROOM STOOL", the entire contents of which are incorporated herein by reference.

TECHNICAL FIELD

Embodiments of the present disclosure relate to the technical field of seating furniture, and in particular, relate to a bathroom stool.

BACKGROUND

During showering in the bathroom, the floor often becomes slippery due to water accumulation, which may lead to slipping or falling accidents. This is particularly dangerous for the elderly and children. To address this issue, people often choose to place a bathroom stool in the bathroom and sit on the stool while showering, thereby reducing the risk of falling down.

In a conventional detachable bathroom stool, stool legs are typically connected to a seat board via screws, and thus tools like a screwdriver are needed for installation.

SUMMARY

In view of the above problem, embodiments of the present disclosure provide a bathroom stool, which not only facilitates assembly and disassembly of the stool but also ensures the stability of connection between the stool legs and the seat board.

Some embodiments of the present disclosure provide a bathroom stool. The bathroom stool includes a seat board, and a plurality of support legs. A plurality of first slots are defined in a bottom edge of the seat board, and a top end of each of the plurality of support legs is inserted into one first slot; a first engagement hole is defined in a side wall of the first slot; and a first through hole is defined in a side wall of the top end of the support leg, and a first compression elastic tab is disposed inside the support leg, a first protrusion being securely arranged on a side of the first compression elastic tab, the first protrusion protruding, from the first through hole, out of the side wall of the support leg; wherein the first protrusion is configured to: during a process that the top end of the support leg is inserted into the first slot, tightly press the first compression elastic tab under pressing by an inner wall of the first slot and retract into the first through hole; and the first protrusion is further configured to, in response to full insertion of the support leg into the first slot, extend out of the first through hole and be engaged in the first engagement hole under a restoration force of the first compression elastic tab.

In some embodiments, the first compression elastic tab is bent to form a first segment and a second segment that define an angle therebetween, wherein a free end of the first segment and a free end of the second segment are respectively abutted against two opposite sides of the support leg, and the first protrusion is securely arranged on a side of the first segment facing away from the second segment; wherein the first segment is configured to be further bent in response to the first protrusion being pressed by the inner wall of the first slot, wherein an angle between the first segment and the second segment decreases.

In some embodiments, a guide inclined surface is arranged at a position on the inner wall of the first slot at an opening and under the first engagement hole, wherein a wall thickness of the first slot at the guide inclined surface progressively increases inward from the opening, and the guide inclined surface is configured to progressively increase a force applied to the first protrusion in the course of inserting the support leg into the first slot.

In some embodiments, a press portion is extended along a depth direction on an inner side wall of the first slot, wherein the press portion is configured to clamp the top end of the support leg after the support leg is inserted into the first slot.

In some embodiments, the support leg includes a sleeve and a telescopic rod, wherein a top end of the sleeve is inserted into the first slot, and the first compression elastic tab is arranged inside the sleeve; wherein a first limit portion and a second limit portion are respectively extended on a side wall of the sleeve and a side wall of the telescopic rod, and the telescopic rod is height-adjustably inserted into the sleeve from a bottom end of the sleeve, wherein the first limit portion and the second limit portion are engaged with each other to guide and limit the telescopic rod.

In some embodiments, a plurality of second engagement holes are defined in the sleeve along an extension direction thereof, and a second through hole is defined in the side wall of the telescopic rod, and a second compression elastic tab is arranged inside the telescopic rod, wherein a second protrusion is securely arranged on a side of the second compression elastic tab, the second protrusion protruding, from the second through hole, out of the side wall of the telescopic rod; wherein engagement between the second protrusion and each of the second engagement holes is consistent with engagement between the first protrusion and the first engagement hole.

In some embodiments, a second slot is defined in a side surface of the seat board, wherein a third engagement hole is defined in a side wall of the second slot; the bathroom stool further includes an auxiliary support member, wherein the auxiliary support member comprise an armrest and/or a backrest; and the auxiliary support member has a bracket free end extending along a horizontal direction at a bottom of the auxiliary support member, wherein a through hole is defined in a side wall of the bracket free end, and a third compression elastic tab is arranged inside the bracket free end, a third protrusion is securely arranged on a side of the third compression elastic tab, the third protrusion protruding, from the third through hole, out of the side wall of the bracket free end; wherein engagement between the third protrusion and the third engagement hole is consistent with engagement between the first protrusion and the first engagement hole.

In some embodiments, a connection plate is extended downward from an edge of the seat board, wherein an inverted triangular catch block is arranged on an inner wall of the connection plate; and the bathroom stool further includes an item accommodation rack, wherein a hook is arranged on a side of the item accommodation rack, and the hook extends from a bottom of the connection plate to engage with the inverted triangular catch block, such that the item accommodation rack and the hook are engaged to be clamped and secured to the connection plate.

In some embodiments, the bathroom stool further includes a reinforcement bracket, wherein the reinforcement bracket is detachably connected between the plurality of support legs to tension the plurality of support legs against each other.

In some embodiments, the reinforcement bracket includes a plurality of reinforcement rods, wherein each of the plurality of reinforcement rods is connected between two support legs, and the plurality of reinforcement rods are intersected with each other and are detachably connected at an intersection.

Some embodiments of the present disclosure provide a bathroom stool featuring a detachable design between the seat board and the support legs, such that space requirements for packaging and transportation are reduced. After the seat board and the support legs are delivered to users in a disassembled form, the users have to manually assemble the seat board and the support legs. To enhance product competitiveness and simplify the assembly process for the users, the present disclosure adopts a plug-in connection structure between the seat board and the support legs. Considering that plug-in structure may loosen over time, the present disclosure addresses the issue by equipping the support legs with elastically retractable first protrusions that are engaged with the first engagement holes in the side walls of the first slots. This design prevents the support legs from loosening or detaching after extended use. Furthermore, the first protrusions are secured relative to the first compression elastic tab. This configuration enables the first protrusions to retract and automatically reset with no need of limiting the first compression elastic tab inside the support legs. In this way, the internal structure of the support legs is simplified, reducing production costs and assembly complexity.

The above description only summarizes the technical solutions of the present disclosure. Specific embodiments of the present disclosure are described hereinafter to better and clearer understand the technical solutions of the present disclosure, to practice the technical solutions based on the disclosure of the specification, and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

Figure 1:
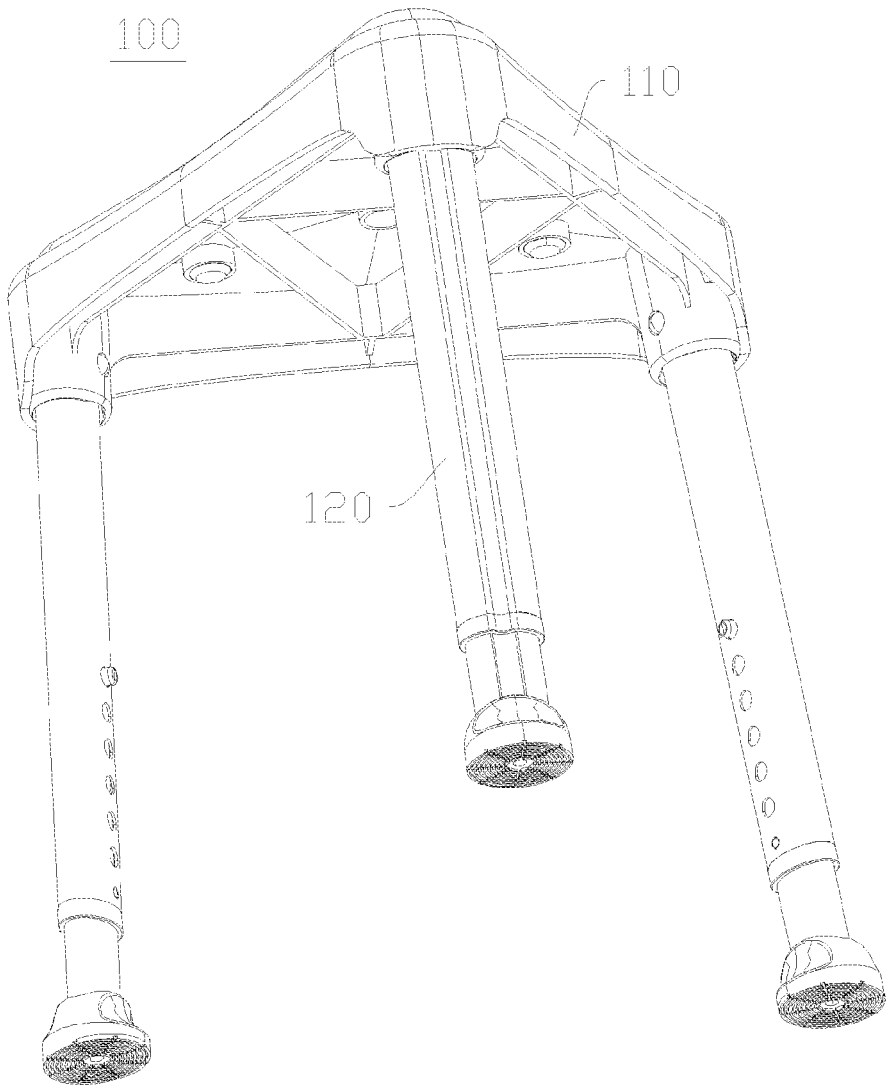
FIG. 1 is a schematic perspective view of a bathroom stool according to some embodiments of the present disclosure.

Reference numerals in the embodiments and denotations thereof:

400—bathroom stool;

110—seat board; 111—first slot; 112—first engagement hole; 113—guide inclined surface; 114—press portion; 115—second slot; 116—third engagement hole; 117—connection plate; 1171—inverted triangular catch block; 118—seat board body; 1181—connection hole; 119—cushion; 1191—connection post;

120—support leg; 121—first through hole; 122—first compression elastic tag; 1221—first segment; 1222—second segment; 123—first protrusion; 124—sleeve; 1241—first limit portion' 1242—second engagement hole; 125—telescopic rod; 1251—second limit portion; 1252—second through hole; 1253—second compression elastic tab; 1254—second protrusion;

130—auxiliary support member; 131—armrest; 132—backrest; 133—bracket free end; 1331—third through hole; 1332—third compression elastic tab; 1333—third protrusion;

140—item accommodation rack; 141—hook;

150—reinforcement bracket; 151—reinforcement rod; 152—hand-tightened bolt.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Unless defined otherwise, all technical and scientific terms used herein have the same meaning as commonly understood by one of ordinary skill in the art to which the present disclosure pertains. The terms used herein in the specification of present disclosure are only intended to illustrate the specific embodiments of the present disclosure, instead of limiting the present disclosure. The terms "comprise," "include," and any variations thereof in the specification, claims, and the description of the drawings of the present disclosure are intended to cover a non-exclusive inclusion.

In the description of the present disclosure, the terms "first," "second," and the like are only used for distinguishing different objects, but shall not be understood as indication or implication of relative importance or implicit indication of the number of the specific technical features, the specific sequence or priorities. In the description of the embodiments of the present disclosure, the term "multiple" or "a plurality of" signifies at least two, unless otherwise specified.

The terms "example" and "embodiment" in this specification signify that the specific characteristic, structures or features described with reference to the embodiments may be covered in at least one embodiment of the present disclosure. This term, when appearing in various parts of the specification, neither indicates the same embodiment, nor indicates an independent or optional embodiment that is exclusive of the other embodiments. A person skilled in the art would implicitly or explicitly understand that the embodiments described in this specification may be incorporated with other embodiments.

In the description of the embodiments of the present disclosure, the term "and/or" is merely an association relationship for describing associated objects, which represents that there may exist three types of relationships. For example, the phrase "A and/or B" may indicate (A), (B), or (A and B). In addition, the forward-slash symbol "/" generally represents an "or" relationship between associated objects before and after the symbol.

In the description of the embodiments of the present disclosure, the term "multiple" or "a plurality of" signifies more than two (including two), unless otherwise specified. Likewise, the term "a plurality of groups" or "multiple groups" signifies more than two groups (including two groups), and the term "a plurality of pieces" or "multiple pieces" signifies more than two pieces (including two pieces).

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In the description of the embodiments of the present disclosure, it should be noted that unless otherwise specified and defined, the terms "mounted," "coupled," "connected," "secured," and derivative forms thereof shall be understood in a broad sense, which, for example, may be understood as secured connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In response to the current issue of complicated assembly and disassembly between the seat board and the support legs of the bathroom stool, and in order to facilitate easy packaging and transportation of the stool while enabling users to assemble the stool effortlessly, the present disclosure proposes a bathroom stool where a seat board and support legs are first installed via plug-in connection, eliminating the need for additional tools and making the assembly process simple and easy.

Furthermore, considering that plug-in structure may become loose and lack stability, elastic protrusions have been designed on the support legs. The contraction of the protrusions allows the support legs to be smoothly inserted into the slots in the seat board. The automatic rebound of the protrusions enables the protrusions to be engaged with the engagement holes in the side wall of the slots, thereby securely fastening the support legs in the slots. When disassembling the support legs, the user only needs to press the protrusions with their fingers to compress the protrusions, and then pull the support legs out of the slots. Neither installation nor disassembly requires any additional tool, and thus the process is simple and convenient.

During the structural design of the elastic contraction of the protrusion, the inventors consider using a compression spring to achieve the elastic compression. However, since the compression spring needs to be arranged inside the support leg and needs to be mounted on a limit post to ensure the correct direction of the force, this introduces more detailed requirements for the internal structure and assembly of the support leg. This may inevitably increase the production cost and assembly difficulty of the support leg.

To address this, the present disclosure uses a compression elastic tab to achieve the contraction and automatic rebound of the protrusion. Specifically, the compression elastic tab is arranged inside the support leg, and the protrusion is securely arranged on a side of the compression elastic tab. The compression elastic tab provides an outward force to the protrusion, such that the protrusion extends out of the through-hole in the side wall of the support leg and protrudes from the side wall of the support leg in its default state. Moreover, in the case that the protrusion is compressed by the inner wall of the slot, the protrusion may not fully retract into the interior of the support leg, and instead, the protrusion may retract into the through-hole in the side wall of the support leg. The inner wall of the through-hole may limit the movement of the protrusion, and prevents the protrusion from shifting. Correspondingly, the compression elastic tab secured relative to the protrusion may not move. Therefore, the compression elastic tab arranged inside the support leg does not require a limit structure to ensure its precise positioning, such that it is ensured that the compression elastic tab provides an accurately directed force to the protrusion. This also simplifies the internal structure of the support leg, and reduces the production costs and assembly difficulty.

Figure 2:
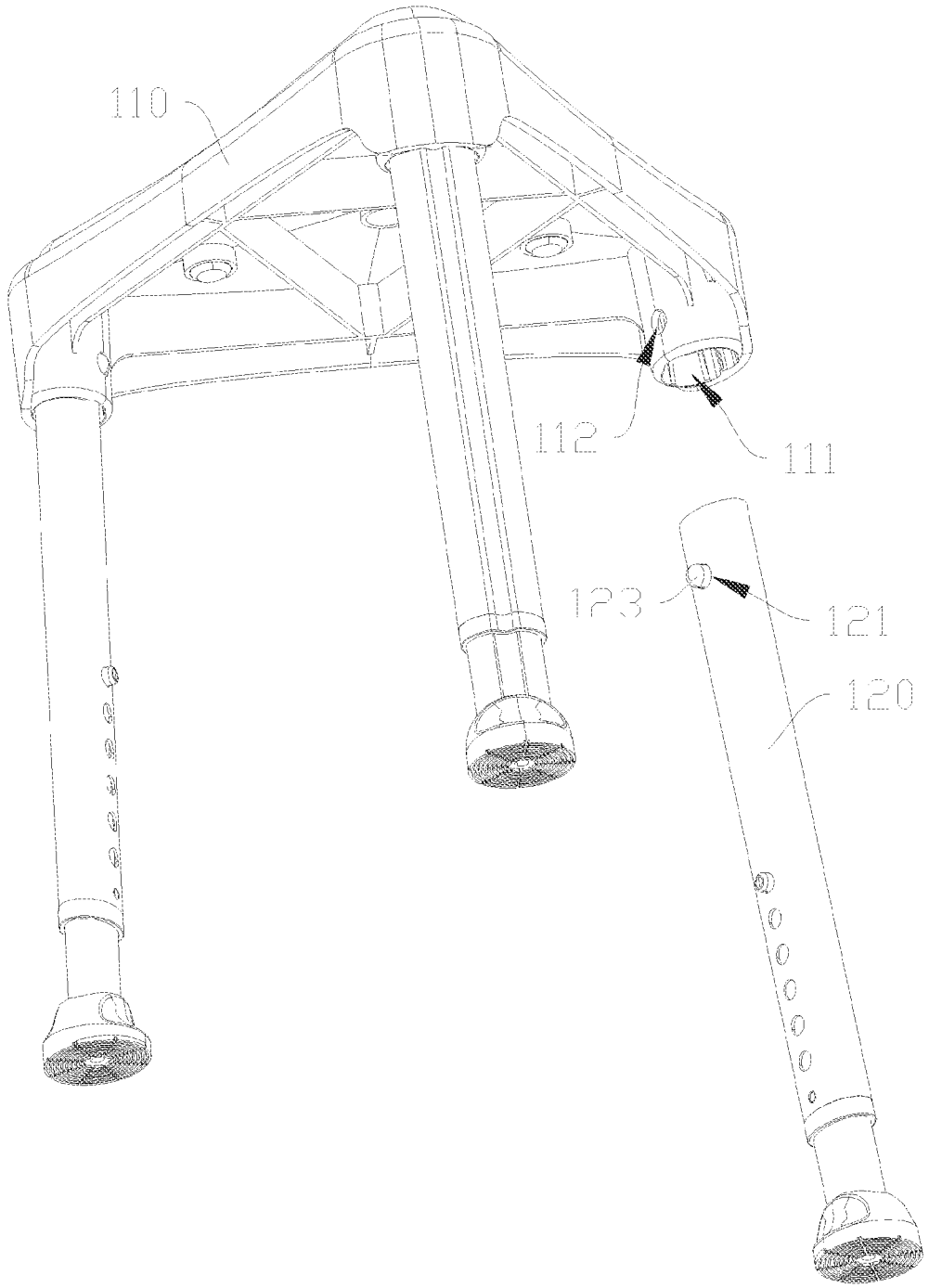
FIG. 2 is a schematic exploded structural view of support legs and a seat board in a bathroom stool according to some embodiments of the present disclosure.
Figure 3A:
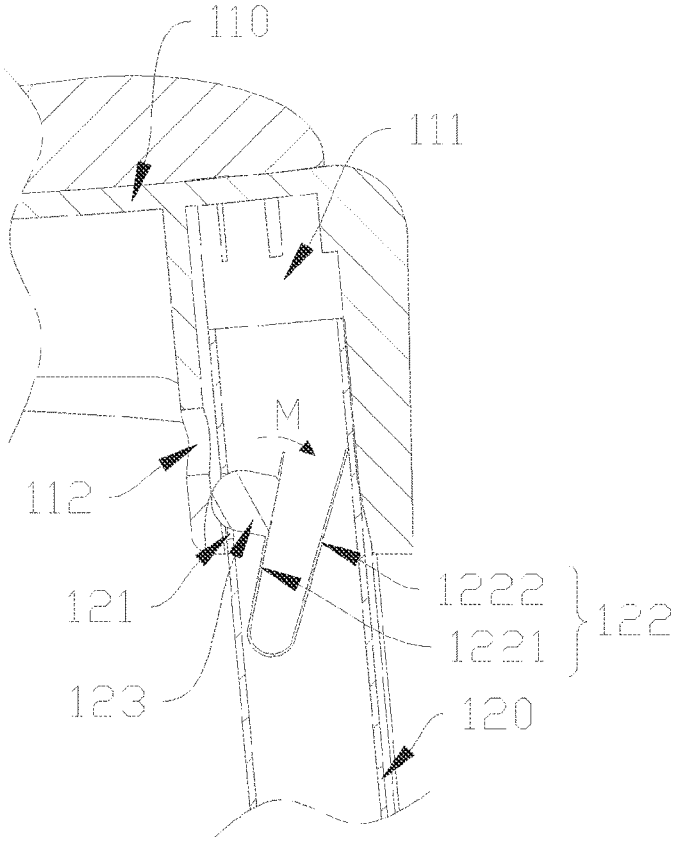
FIG. 3A is a schematic sectional view of an engagement position between a support leg and a first slot in a process of inserting the support leg into the first slot in a bathroom stool according to some embodiments of the present disclosure.
Figure 3B:
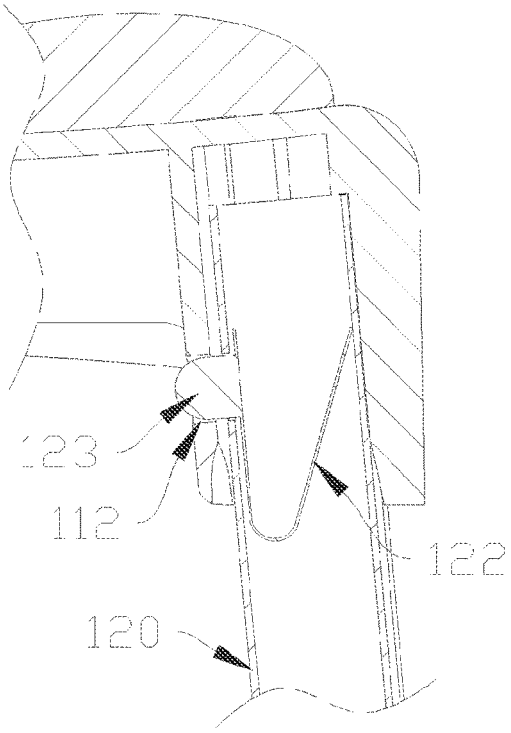
FIG. 3B is a schematic sectional view of an engagement position between a support leg and a first slot in the case that the support leg is fully inserted into the first slot in a bathroom stool according to some embodiments of the present disclosure.

First referring to FIG. 1 and FIG. 2, FIG. 1 illustrates a three-dimensional structure of a bathroom stool 100 according to some embodiments of the present disclosure; and FIG. 2 illustrates an exploded structure of one support leg of the bathroom stool 100. As illustrated in FIG. 1 and FIG. 2, the bathroom stool 100 includes a seat board 110 and a plurality of support legs 120. A plurality of slots 111 are defined in a bottom edge of the seat board 110, and a top end of each of the support legs 120 is correspondingly inserted into one of the first slots 111. A first engagement hole 112 is defined in a side wall of the first slot 111. Further referring to FIG. 3A and FIG. 3B, FIG. 3A illustrates a perspective structure of the support leg 120 being inserted into the first slot 111, and FIG. 3B illustrates a perspective structure of the support leg 120 that is fully inserted in the first slot 111. As illustrated in FIG. 3A and FIG. 3B, a first through hole 121 is defined in a side wall of the top end of the support leg 120, and a first compression elastic tab 122 is arranged inside the support leg 120. Afirst protrusion 123 is securely arranged on a side of the first compression elastic tab 122. The first protrusion 123 protrudes, from the first through hole 121, out of the side wall of the support leg 120.

Subsequently, actions of the first protrusion 123 and the first compression elastic tab 122 in the process of inserting the top end of the support leg 120 into the first slot 111 are described.

First referring to FIG. 3A, the first protrusion 123 is configured to, during the process of inserting the top end of the support leg 120 into the first slot 111, tightly press the first compression elastic tab 122 under pressing by an inner wall of the first slot 111 and retract into the first through hole 121. Specifically, in a default state, the first protrusion 112is subjected to an elastic force from the first compression elastic tab 122 and thus protrudes out of the first through hole 121 (as illustrated in FIG. 2). In the case that the first protrusion 123 enters the first slot 111 as illustrated in FIG. 3A, the first protrusion may retract inward due to pressing from the inner wall of the first slot 111, such that the first compression elastic tab is deformed along an arrow M and is tightly pressed, and the first protrusion 123 may retract within the first through hole 121.

Subsequently referring to FIG. 3B, the first protrusion 123 is configured to, in response to full insertion of the support leg 120 into the first slot 111, extend out of the first through hole 121 and be engaged in the first engagement hole 112 under a restoration force of the first compression elastic tab 122. Specifically, in the case that the support leg 120 is fully inserted into the first slot 111, the first through hole 121 moves to the position corresponding to the first engagement hole 112. In this case, the first protrusion 123 is not compressed or limited by the inner wall of the first slot 111, the first compression elastic tab 122 restores from the deformation, and drives the first protrusion 123 to extend out of the first through hole 121 and to be engaged in the first engagement hole 112, such that the support leg 120 may not easily detach from the first slot 111. In this way, the stability of the connection between the support leg 120 and the seat board 110 is improved.

Opposite or reverse operations are performed for the disassembly of the support leg 120. A finger of one hand is inserted into the first engagement hole 112 to press the first protrusion 123 into the first through hole 121, while the other hand pulls the support leg 120 out of the first slot 111, thereby completing the disassembly of the support leg 120.

The first protrusion 123, as illustrated in FIGS. 3A and 3B, may adopt a cylindrical structure with a hemispherical end. The hemispherical end not only prevents severe structural interference with the notch of the first slot 111 during insertion, but also reduces the friction between the first slot's 111 inner wall and the protrusion during insertion, achieving easy insertion. The cylindrical structure ensures that after the first protrusion 123 extends into the first engagement hole 112, the side surface of the first protrusion 123 may be abutted against and limit the inner wall of the first engagement hole 112 in a larger area, such that the support leg 120 is prevented from being easily pulled out. In addition, the first protrusion 123 may also adopt a cylindrical structure with an end designed as an inclined surface or a smooth curved surface. The specific principle and effect are similar to those described above.

In summary, the embodiments of the present disclosure provide the bathroom stool 100 featuring the detachable design between the seat board 110 and the support legs 120, such that space requirements for packaging and transportation are reduced. After the seat board 110 and the support legs 120 are delivered to users in a disassembled form, the users have to manually assemble the seat board and the support legs. To enhance product competitiveness and simplify the assembly process for the users, the present disclosure adopts a plug-in connection structure between the seat board 110 and the support legs 120. Considering that plug-in structure may loosen overtime, the present disclosure addresses the issue by equipping the support leg 120 with an elastically retractable first protrusion 123 that is engaged with the first engagement hole 112 in the side wall of the first slot 111. This design prevents the support leg 120 from loosening or detaching after extended use. Furthermore, the first protrusion 123 is secured relative to the first compression elastic tab 122. This configuration enables the first protrusion 123 to retract and automatically reset with no need of limiting the first compression elastic tab 122 inside the support leg 120. In this way, the internal structure of the support leg 120 is simplified, reducing production costs and assembly complexity.

Figure 4:
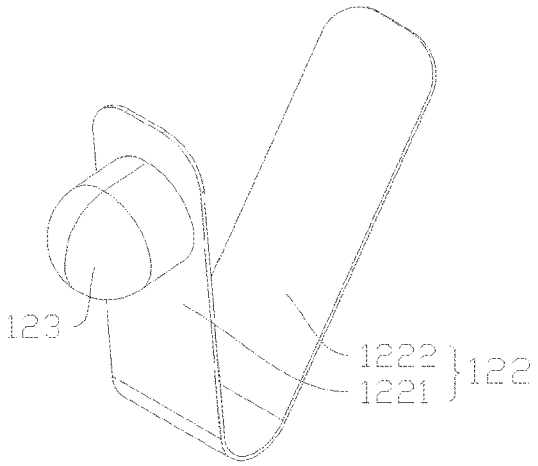
FIG. 4 is a schematic structural view of a first compression elastic tab in a bathroom stool according to some embodiments of the present disclosure.

Referring to FIGS. 3A and 3B, and further in conjunction with FIG. 4, a three-dimensional structure of a first compression elastic tab 122 and a first protrusion 123 is illustrated. In the specific embodiments, the first compression elastic tab 122 is bent to form two angled segments: a first segment 1221 and a second segment 1222. Free ends of the first segment 1221 and the second segment 1222 are respectively in contact with the inner walls on opposite sides of the support leg 120. The first protrusion 123 is securely arranged on a side of the first segment 1221 facing away from the second segment 1222. As illustrated in FIG. 3A, the first segment 1221 is configured to be further bent in response to the first protrusion 123 being pressed by the inner wall of the first slot 111, wherein an angle between the first segment 1221 and the second segment 1222 decreases.

In the embodiments, the first compression elastic tab 122 is integrally bent to form the first segment 1221 and the second segment 1222 that define an angle therebetween. The free end of the first segment 1221 is in contact with the inner wall of the support leg 120 on the side facing toward the first through hole 121, and the free end of the second segment 1222 is in contact with the inner wall of the support leg 120 on the side where the first through hole 121 is defined. This configuration allows the elastic force at the bend of the first compression elastic tab 122 to provide a restoration force to the first protrusion 123 on the first segment 1221.

Figure 5:
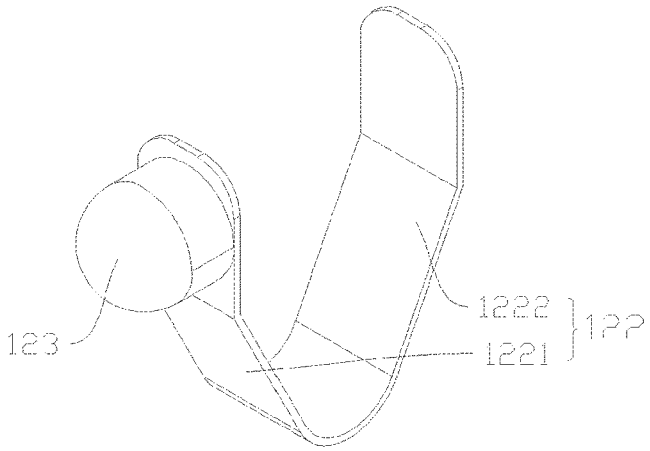
FIG. 5 is a schematic structural view of a first compression elastic tab in a bathroom stool according to some embodiments of the present disclosure.
Figure 6:
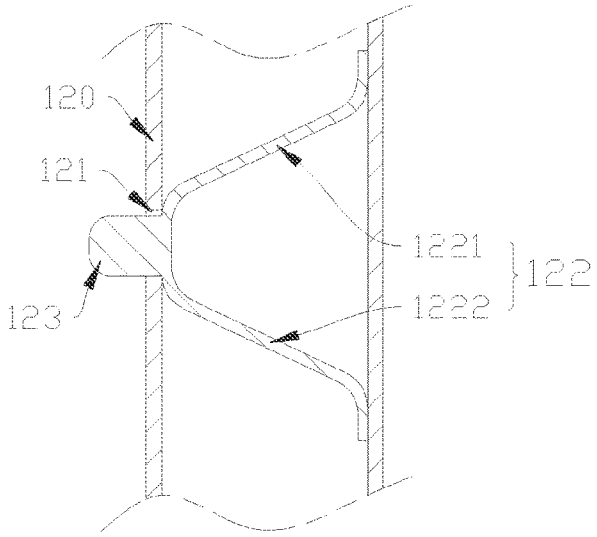
FIG. 6 is a schematic structural view of a first compression elastic tab in a bathroom stool according to some embodiments of the present disclosure.

As illustrated in FIG. 5, the free ends of the first segment 1221 and the second segment 1222 of the first compression elastic tab 122 may be further bent to form surfaces in contact with the inner walls on opposite sides of the support leg 120. This design enhances the elastic force applied to the first protrusion 123. As illustrated in FIG. 6, in the first compression elastic tab 122, the free ends of both the first segment 1221 and the second segment 1222 may be both in abutment against the inner wall of the support leg 120 on the side facing toward the first through hole 121. In this case, the first protrusion 123 is arranged at the bend of the first compression elastic tab 122. In the case that the first protrusion 123 is subjected to a force and is compressed, the first segment 1221 and the second segment 1222 expand outward relative to each other, and hence the angle defined therebetween increases. Once the force on the first protrusion 123 is released, the first segment 1221 and the second segment 1222 restore to their original shapes and retract relative to each other, and hence the angle defined therebetween decreases. This configuration effectively achieves the retraction and automatic reset of the first protrusion 123.

Figure 7:
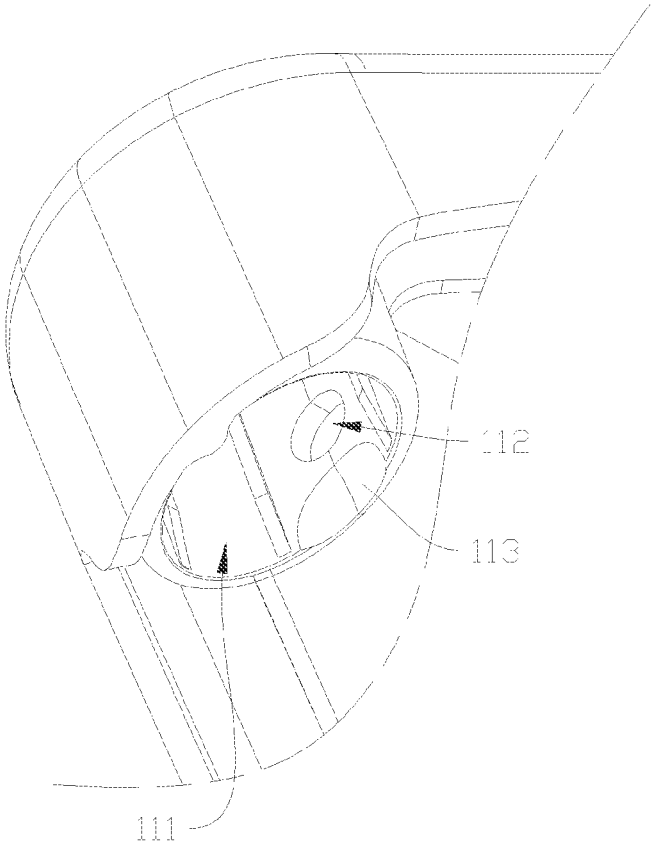
FIG. 7 is a schematic structural view of a guide inclined surface at an opening of a first slot in a bathroom stool according to some embodiments of the present disclosure.

To further facilitate effortless and smooth insertion of the top end of the support leg 120 into the first slot 111, the present disclosure further proposes an embodiment. Specifically, referring to FIG. 7, a structure of an opening of a first slot 111 is illustrated. As illustrated in FIG. 7, a guide inclined surface 113 is arranged at a position on the inner wall of the first slot 111 at the opening and under the first engagement hole 112, wherein a wall thickness of the first slot 111 at the guide inclined surface 113 progressively increases, and the guide inclined surface 113 is configured to progressively increase a force applied to the first protrusion 123 in the course of inserting the support leg 120 into the first slot 111.

By designing a guide inclined surface 113 with a wall thickness that progressively increases from the notch of the first slot 111 inward, the top end of the support leg 120 may be easily inserted into the first slot 111. At the notch, a smaller wall thickness allows the first protrusion 123 to enter smoothly without significant collisions or interference. As the insertion goes deeper, the guide inclined surface 113 whose wall thickness progressively increases presses the first protrusion 123 and progressively increases the force applied on the first protrusion 123, such that the first protrusion 123 is progressively pushed back into the first through hole 121. This design ensures that the resistance encountered during the insertion of the support leg 120 progressively increases. Consequently, the user may progressively increase the push force to the support leg 120 during the insertion process, such that the insertion process is smooth, and any sudden increase in resistance that may disrupt the insertion action is prevented.

Figure 8:
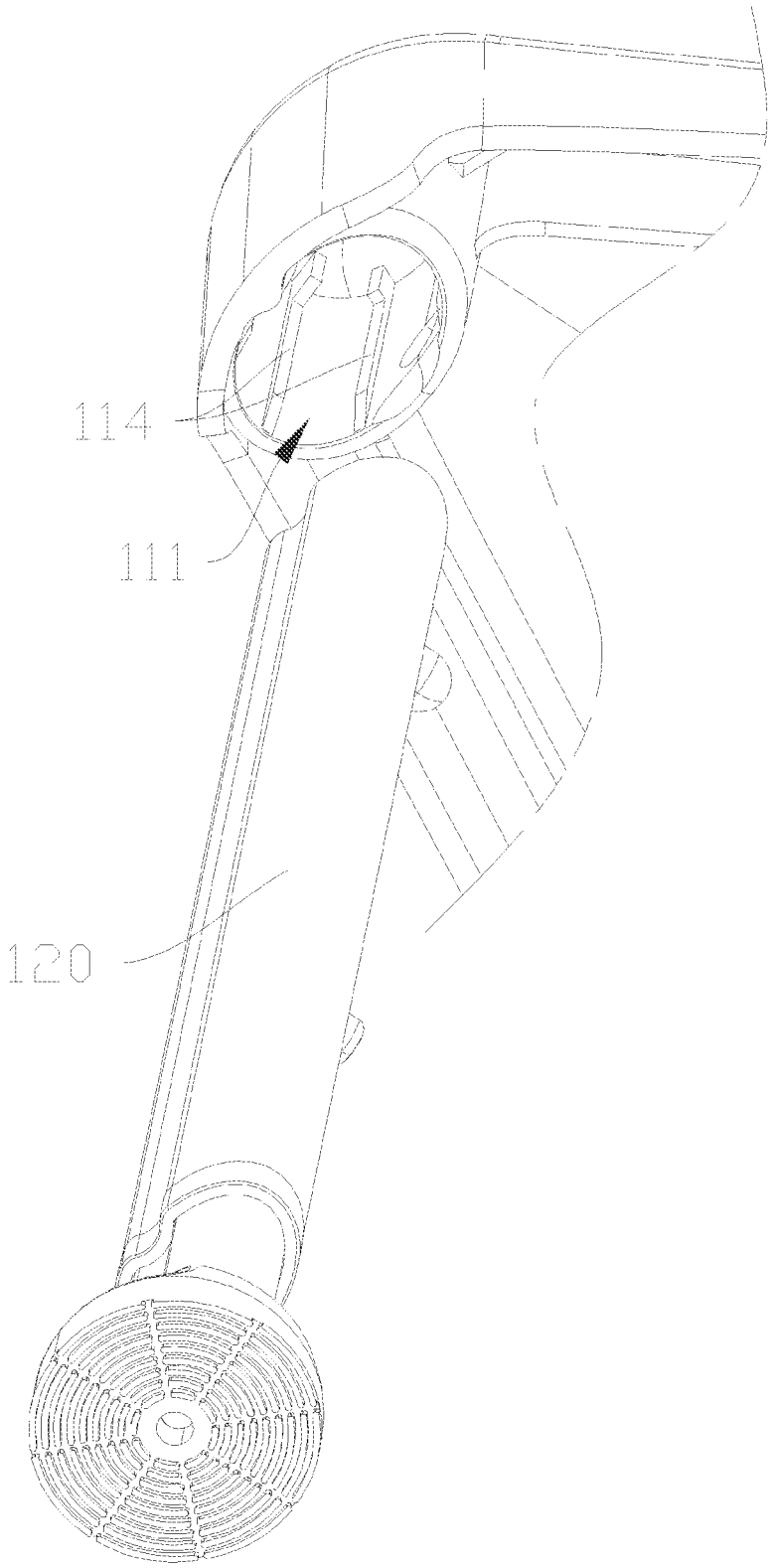
FIG. 8 is a schematic exploded structural view of a first slot and a support leg in a bathroom stool according to some embodiments of the present disclosure.
Figure 9:
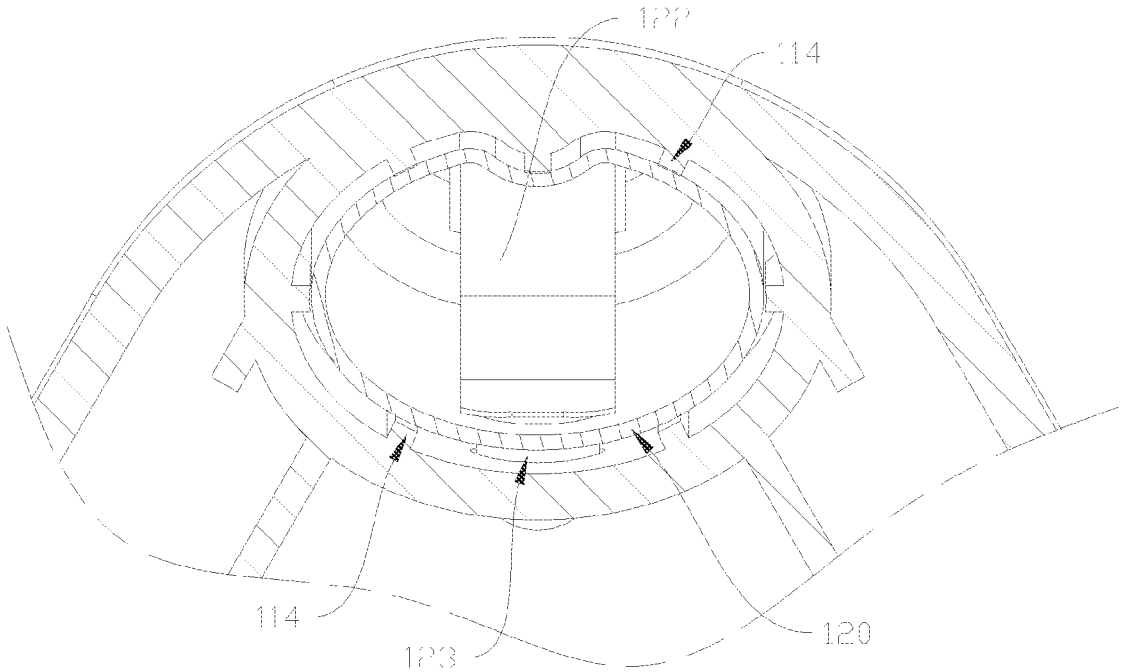
FIG. 9 is a schematic sectional view of engagement between a support leg and a press portion in a first slot in a bathroom stool according to some embodiments of the present disclosure.

To further enhance the stability of the connection between the support leg 120 and the seat board 110, the present disclosure also proposes an alternative embodiment. For details, reference may be made to FIGS. 8 and 9. FIG. 8 illustrates an exploded structural view of the support leg 120 and the first slot 111, and FIG. 9 illustrates a sectional view of the support leg 120 that is inserted into the first slot 111. As illustrated in FIGS. 8 and 9, a press portion 114 is extended along a depth direction on an inner side wall of the first slot 111, wherein the press portion 114 is configured to clamp the top end of the support leg 120 after the support leg 120 is inserted into the first slot 111.

Specifically, the press portion 114 may take the form of a plurality of strip-shaped protrusions arranged circumferentially along the inner wall of the first slot 111, as illustrated in FIGS. 8 and 9. Alternatively, the press portion 114 may be a soft rubber sleeve attached to the inner side wall of the first slot 111. Regardless of whether strip-shaped protrusions or a soft rubber sleeve, the design increases the friction between the press portion 114 and the side wall of the top end of the support leg 120 through pressing, such that the stability of the connection between the support leg 120 and the first slot 111 is enhanced.

Figure 10:
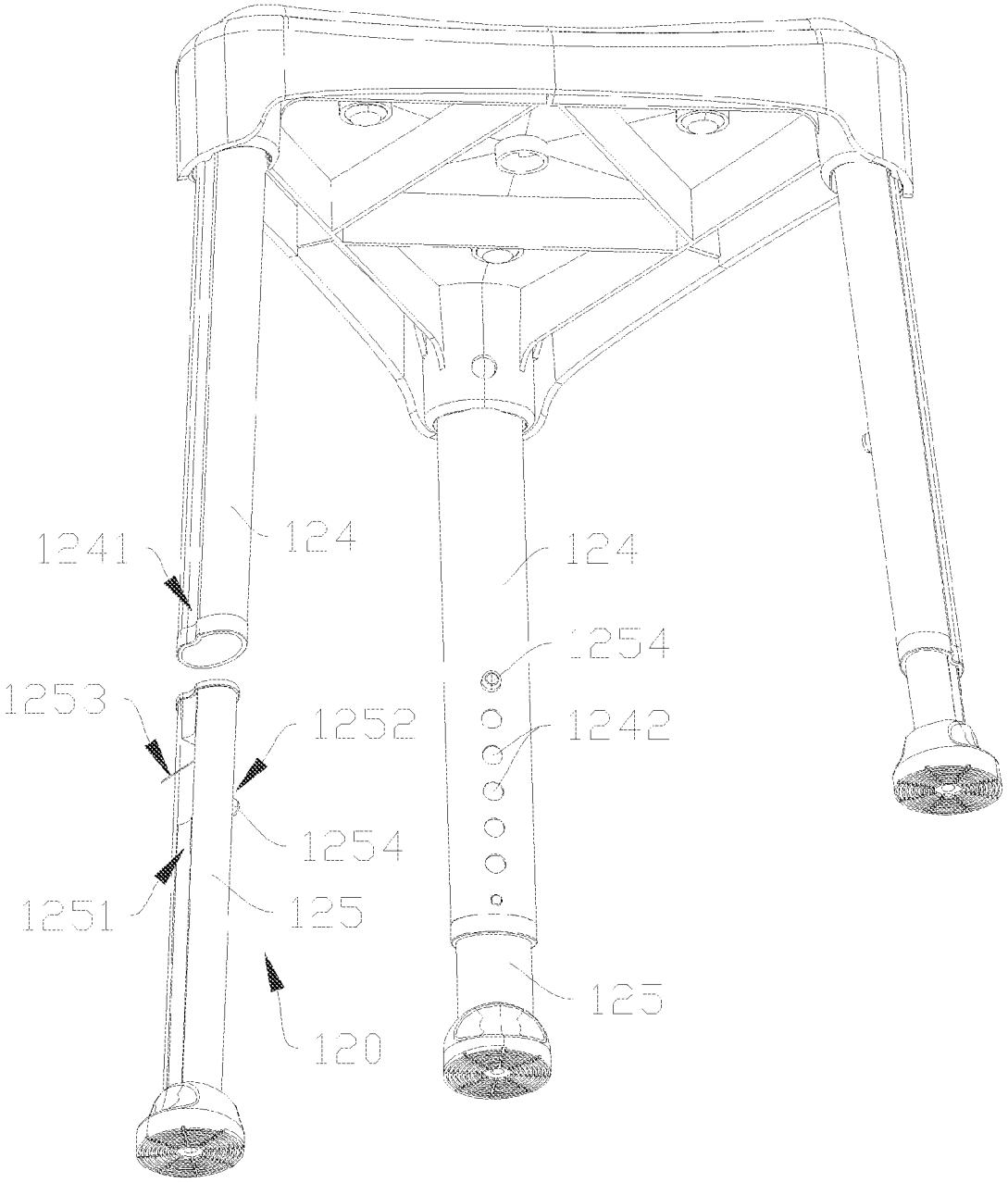
FIG. 10 is a schematic exploded structural view of a sleeve and a telescopic rod in a bathroom stool according to some embodiments of the present disclosure.

To meet user requirements for adjustable heights of the bathroom stool, the present disclosure further incorporates a height-adjustable design for the support leg 120. Referring to FIG. 10, an exploded structure of the support leg 120 in the bathroom stool 100 is illustrated. As illustrated in FIG. 10, the support leg 120 includes a sleeve 124 and a telescopic rod 125. A top end of the sleeve 124 is inserted into the first slot 111, and the first compression elastic tab 122 is installed inside the sleeve 124. A first limit portion 1241 and a second limit portion 1251 are respectively extended on side walls of the sleeve 124 and the telescopic rod 125. The telescopic rod 125 is inserted with adjustable height into the sleeve 124 from the bottom of the sleeve 124, and the first limit portion 1241 and the second limit portion 1251 cooperate with each other to guide and limit the movement of the telescopic rod 125.

In the specific embodiments illustrated in FIG. 10, the support leg 120 adopts an elliptical shape, which provides improved stability compared to the support leg of a circular shape. The first limit portion 1241 and the second limit portion 1251 are strip-shaped recesses respectively arranged on the sleeve 124 and the telescopic rod 125. Before the telescopic rod 125 is inserted from the bottom into the sleeve 124, the first limit portion 1241 and the second limit portion 1251 are aligned, thereby preventing incorrect assembly. During the subsequent insertion process, slidable engagement between the first limit portion 1241 and the second limit portion 1251 serves as a guide mechanism, and meanwhile the telescopic rod 125 are prevented from rotating within the sleeve 124. Additionally, the first limit portion 1241 and the second limit portion 1251 may be implemented as a slot-and-slider arrangement, which is not specifically limited in the embodiments of the present disclosure.

For securing of the telescopic rod 125 at a desired height, the present disclosure further proposes an embodiment. As illustrated in FIG. 10, a plurality of second engagement holes 1242 are arranged along an extension direction thereof in the sleeve 124, a second through hole 1252 is defined in the side wall of the telescopic rod 125, a second compression elastic tab 1253 is arranged inside the telescopic rod 125, and a second protrusion 1254 is securely arranged on a side of the second compression elastic tab 1253. The second protrusion 1254 protrudes, from the second through hole 1252, out of the side wall of the telescopic rod 125. Engagement between the second protrusion 1254 and each of the second engagement holes 1242 is consistent with engagement between the first protrusion 123 and the first engagement hole 112 according to the above embodiments, which is not described herein any further.

In the case that the second protrusion 1254 is engaged with different second engagement holes 1242, the telescopic rod 125 may be secured at the corresponding insertion position, such that the support leg 120 is maintained at a desired height to meet the user's need for different heights of the bathroom stool 100.

Figure 11:
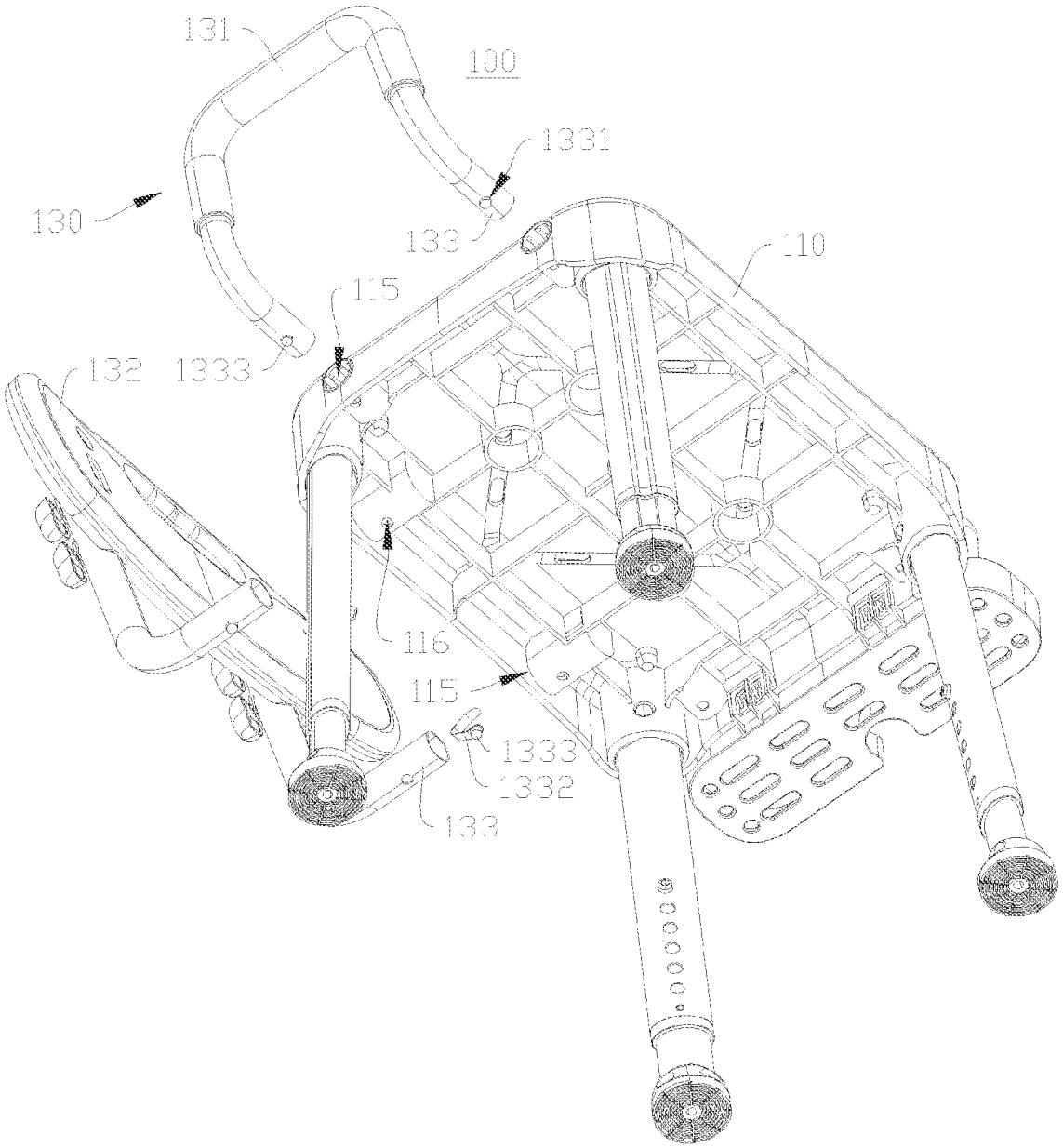
FIG. 11 is a schematic exploded structural view of an auxiliary support member and a seat board in a bathroom stool according to some embodiments of the present disclosure.

In a further embodiment, an auxiliary support member may be installed to enhance the user experience. Referring to FIG. 11, an exploded structure of a bathroom stool according to some embodiments of the present disclosure is illustrated. As illustrated in FIG. 11, a second slot 115 is defined in a side of the seat board 110, and a third engagement hole 116 is defined in a side wall of the second slot 115. The bathroom stool 100 further includes an auxiliary support member 130. The auxiliary support member 130 includes an armrest 131 and/or a backrest 132. The auxiliary support member 130 has a bracket free end 133 that extends horizontally at the bottom thereof. A third through hole 1331 is defined in a side wall of the bracket free end 133, and a third compression elastic tab 1332 is arranged inside the through hole 1331. A third protrusion 1333 is securely arranged on a side of the third compression elastic tab 1332, and the third protrusion 1333 protrudes, from though the third through hole 1331, out of the side wall of the bracket free end 133. Engagement between the third protrusion 1333 and the third engagement hole 116 is different from engagement between the first protrusion 123 and the first engagement hole 112, which is not described herein any further. This design allows the auxiliary support member 130 and the seat board 110 to be packaged and transported separately, and thus users are allowed to easily assemble the auxiliary support member 130 onto the seat board 110.

Figure 12:
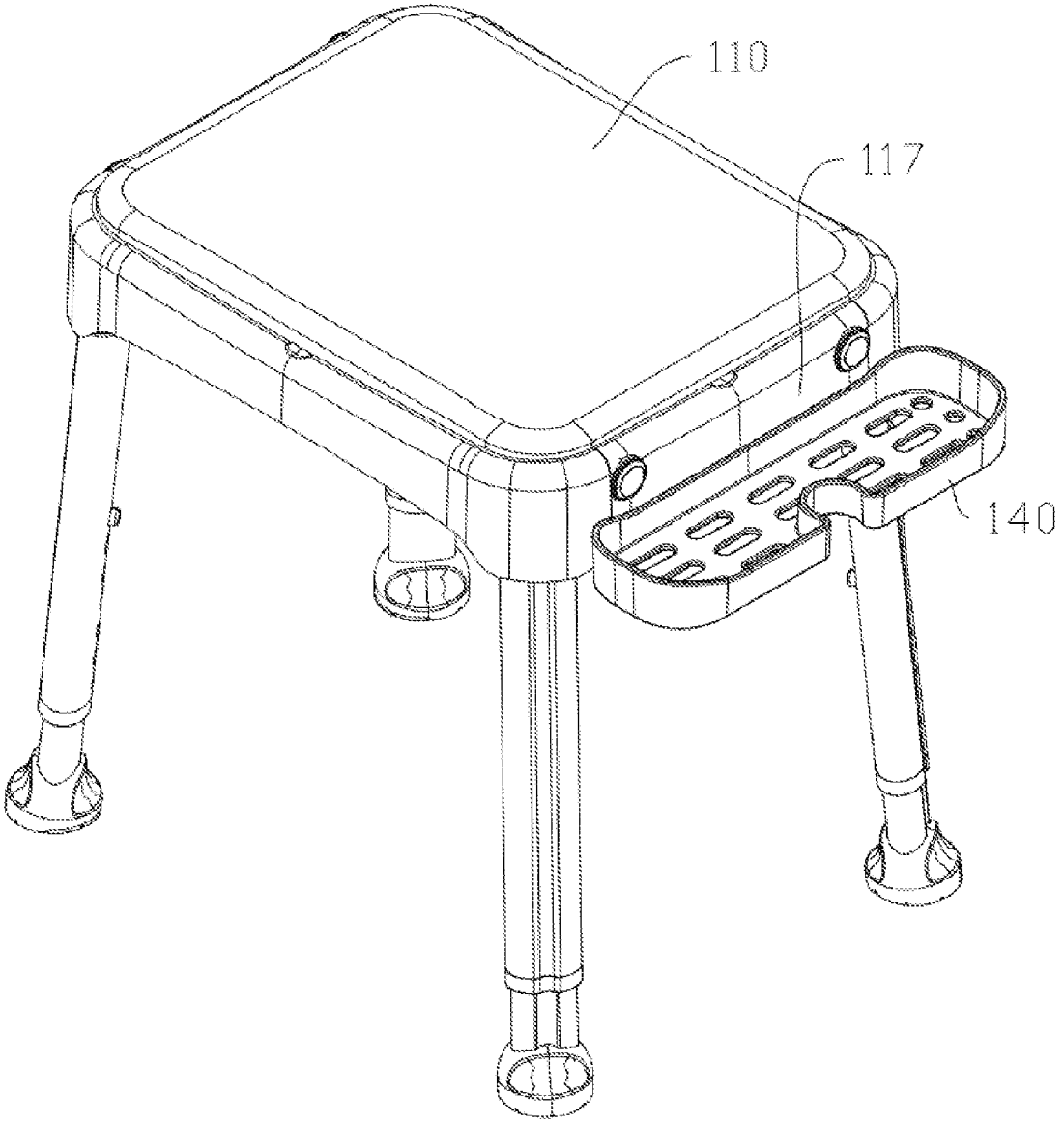
FIG. 12 is a schematic structural view taken from a top perspective of a bathroom stool according to some embodiments of the present disclosure.
Figure 13:
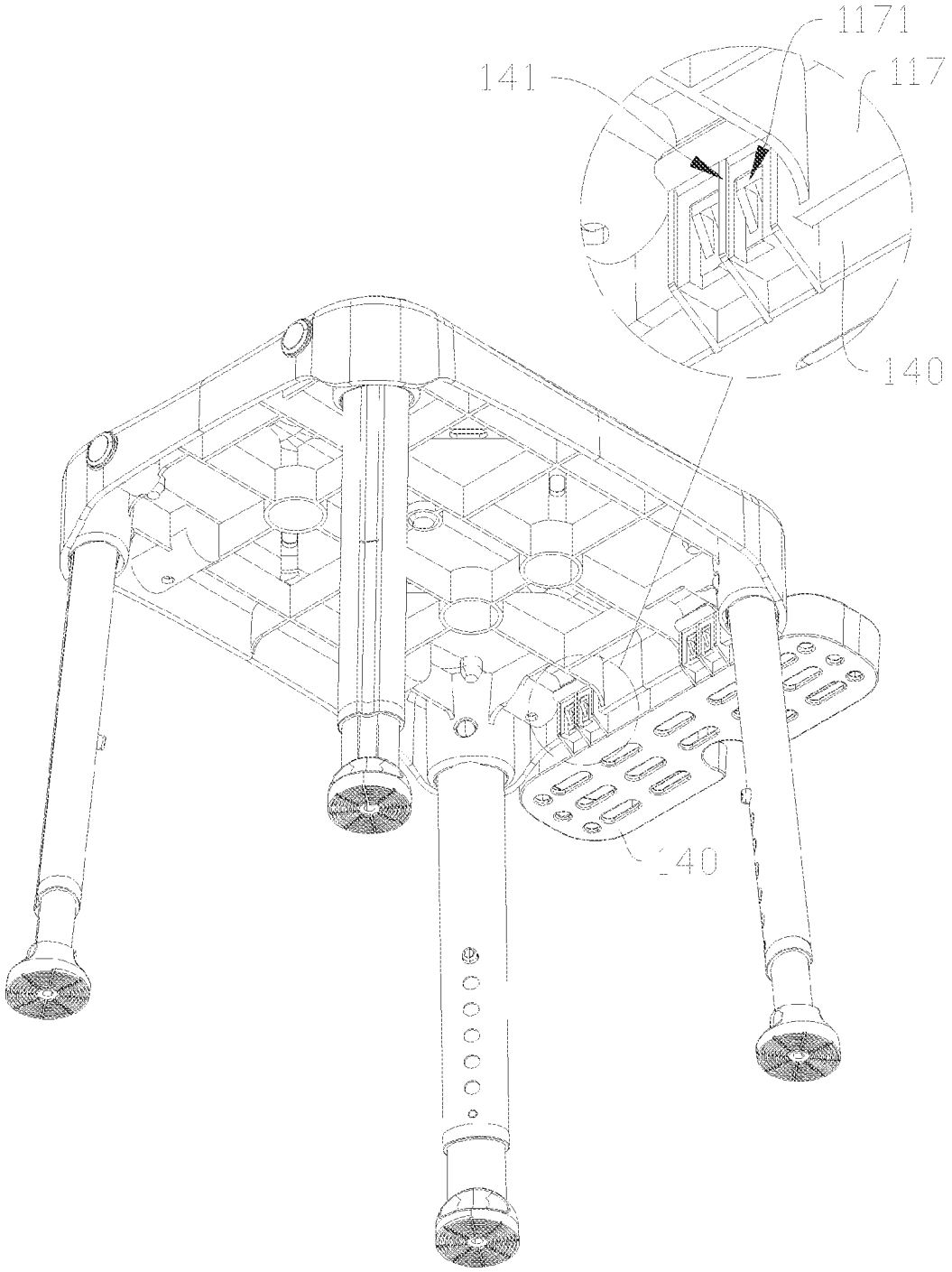
FIG. 13 is a schematic structural view taken from a bottom perspective of a bathroom stool according to some embodiments of the present disclosure.

For convenience during bathing, in order to place and retrieve toiletries easily, the present disclosure also proposes an embodiment. Referring to FIGS. 12 and 13, perspective views of a bathroom stool according to some embodiments of the present disclosure are illustrated. As illustrated in FIGS. 12 and 13, the edge of the seat board 110 extends downward to form a connection plate 117, and an inverted triangular catch block 1171 is arranged on an inner wall of the connection plate 117. The bathroom stool 100 further includes an item accommodation rack 140. A hook 141 is arranged on a side of the item accommodation rack 140. The hook 141 extends from a bottom of the connection plate 117 to be engaged with the inverted triangular catch block 1171, such that the item accommodation rack 140 cooperates with the hook 141 and are clamped and secured to the connection plate 117.

It should be noted that during the process of the hook 141 extending into the bottom of the connection plate 117, an inclined surface of the inverted triangular catch block 1171 press the hook 141 to cause the hook 141 to be deformed. Once fully inserted, the hook 141 rebounds and is engaged with a top surface of the inverted triangular catch block 1171. Simultaneously, a side of the item accommodation rack 140 wherein the hook 141 is arranged may be in abutment against an outer surface of the connection plate 117. Engagement between the hook 141 and the top surface of the inverted triangular catch block 1171, along with abutment between the item accommodation rack 140 and the outer surface of the connection plate 117, ensures that the item accommodation rack 140 is securely held in place on the connection plate 117. The item accommodation rack 140 may also be packaged and transported separately from the seat board 110, and users can easily install the item accommodation rack 140 onto the seat board 110.

Figure 14:
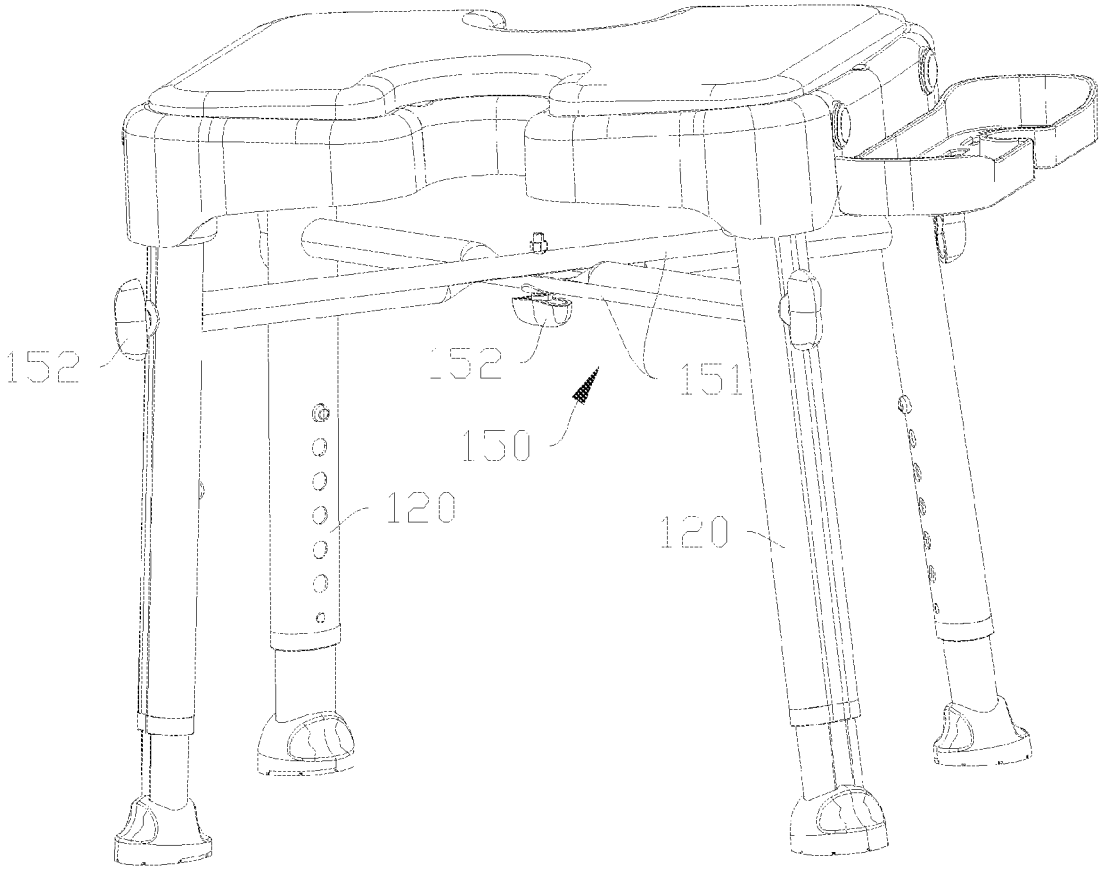
FIG. 14 is a schematic structural view of a bathroom stool according to some embodiments of the present disclosure.

To further enhance the support strength of the bathroom stool 100, the present disclosure also proposes a reinforced design for the support legs. Specifically, referring to FIG. 14, a structure of a bathroom stool 100 according to some embodiments of the present disclosure is illustrated. As illustrated in FIG. 14, the bathroom stool 100 further includes a reinforcement bracket 150. The reinforcement bracket 150 is configured to be detachably connected between the plurality of support legs 120 to tension the plurality of support legs 120 against each other.

In the specific embodiments as illustrated in FIG. 14, the reinforcement bracket 150 includes a plurality of reinforcement rods 151, wherein each of the reinforcement rods 151 is connected between two support legs 120, and the plurality of reinforcement rods 151 are intersected with each other and are detachably connected at an intersection.

As illustrated in FIG. 14, taking four support legs 120 as an example, two reinforcement rods 151 are arranged. Each of the reinforcement rods 151 has both ends detachably connected to two diagonally opposite support legs 120 via hand-tightened bolts 152. This arrangement achieves tensioning and securing of the support legs 120 while facilitating easy assembly and disassembly. The two reinforcement rods 151 are also interconnected at their crossing points with the hand-tightened bolts 152, such that the structural stability of the reinforcing rods 151 is enhanced.

In addition to the aforementioned configuration, the reinforcement bracket 150 may also adopt an annular structure defined by a plurality of rods in a surrounding pattern. This arrangement surrounds an outer circumference of the plurality of support legs 120 to tightly press and secure the plurality of support legs 120, such that the support legs 120 are prevented from bending or even breaking.

Figure 15:
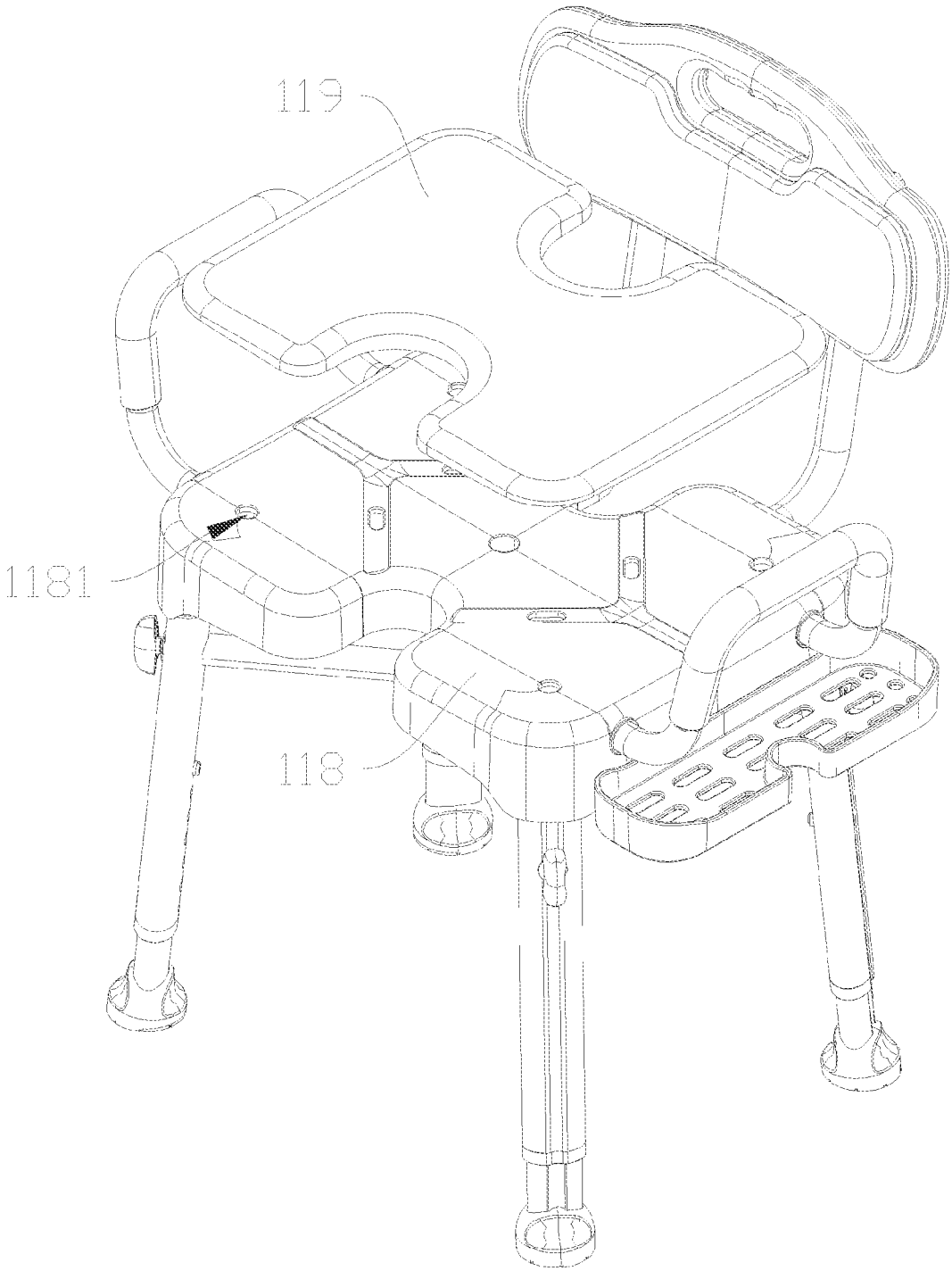
FIG. 15 is a schematic exploded structural view of a seat board body and a cushion in a bathroom stool according to some embodiments of the present disclosure.
Figure 16:
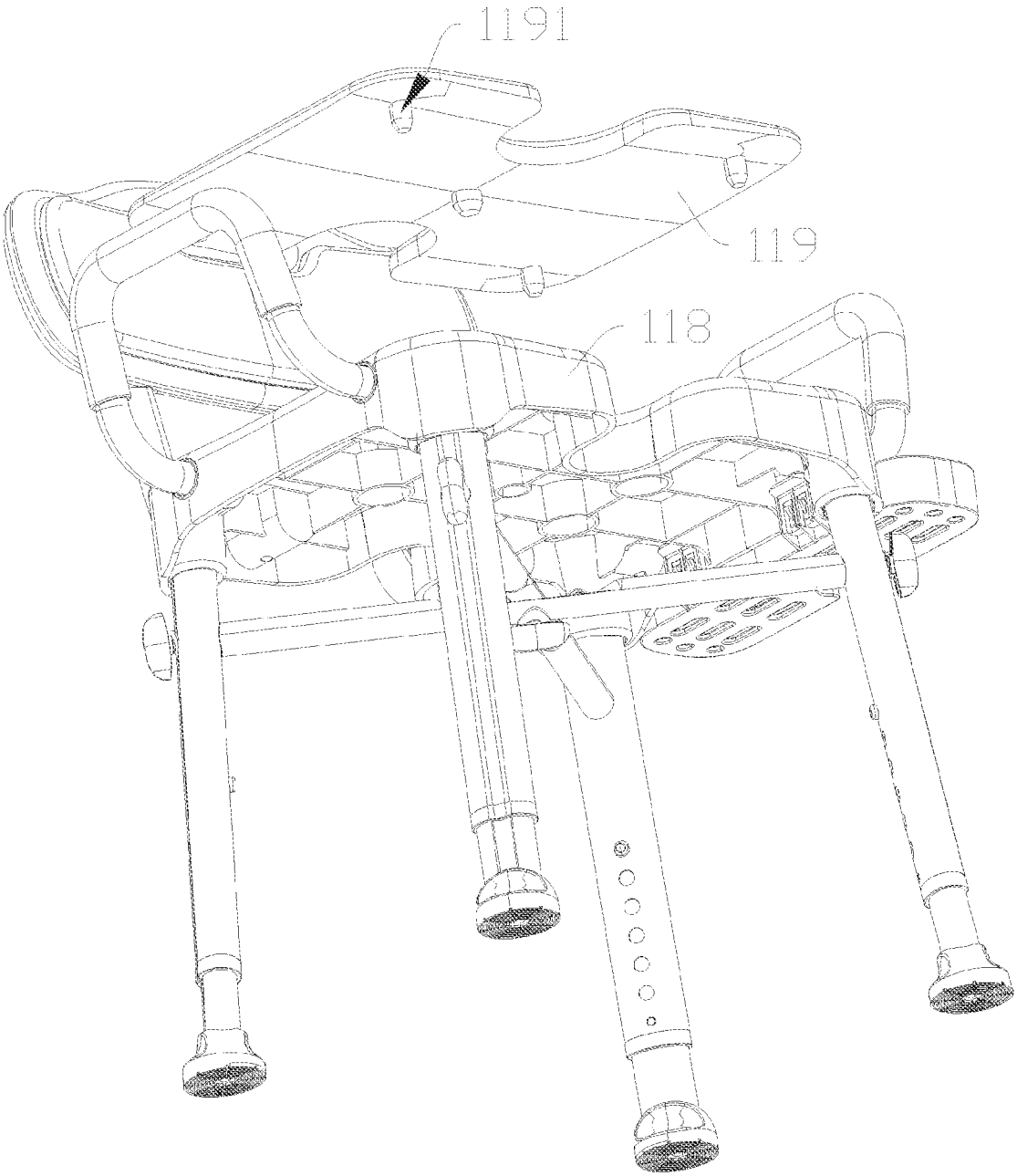
FIG. 16 is a schematic exploded structural view of a seat board body and a cushion in a bathroom stool according to some embodiments of the present disclosure.

To enhance the comfort of sitting on the bathroom stool 100, the present disclosure further proposes an embodiment. Specifically, referring to FIGS. 15 and 16, FIGS. 15 and 16 illustrate structures of a bathroom stool form two perspectives according to some embodiments of the present disclosure, with the seat board 110 in an exploded view. As illustrated in FIGS. 15 and 16, the seat board 110 includes a seat board body 118 and a cushion 119. A connection hole 1181 is defined in the seat board body 118, and a connection post 1191 is arranged on the cushion 119. The connection post 1191 is inserted into the connection hole 1181, such that the cushion 119 is secured to the seat board body 118.

To ensure the support strength, the seat board body 118 is typically made of rigid plastic or a metal material, while the cushion 119 is made of a soft rubber material to provide cushioning for hips of the users, which ensures a comfortable seating experience.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope of the present disclosure. Especially, various technical features mentioned in various embodiments may be combined in any fashion as long as there is no structural conflict.

What is claimed is:

1. A bathroom stool, comprising:

a seat board, wherein a plurality of first slots are defined in a bottom edge of the seat board, a first engagement hole being defined in a side wall of each of the plurality of first slots; and a plurality of support legs, wherein a top end of each of the plurality of support legs is inserted into one first slot of the plurality of first slots corresponding to the support leg, wherein a first through hole is defined in a side wall of the top end of at least one of the plurality of support legs, and a first compression elastic tab is disposed inside the at least one of the plurality of support legs, a first protrusion being securely arranged on a side of the first compression elastic tab, the first protrusion protruding out of the side wall of the at least one support leg through the first through hole;

wherein the first protrusion is configured to: during a process that the top end of the at least one support leg is inserted into a first slot of the plurality of slots corresponding to the at least one support leg, press the first compression elastic tab under pressing from an inner wall of the first slot and retract into the first through hole; and the first protrusion is further configured to, in response to full insertion of the at least one support leg into the first slot, extend out of the first through hole and be engaged in the first engagement hole under a restoration force of the first compression elastic tab;

wherein the at least one support leg comprises a sleeve and a telescopic rod, wherein a top end of the sleeve is inserted into the first slot corresponding to the at least one support leg, and the first compression elastic tab is arranged inside the sleeve;

wherein a first limit portion and a second limit portion are respectively extended on a side wall of the sleeve and a side wall of the telescopic rod, and the telescopic rod is height-adjustably inserted into the sleeve from a bottom end of the sleeve, wherein the first limit portion and the second limit portion are engaged with each other to guide and limit the telescopic rod; wherein a second slot is defined in a side surface of the seat board, wherein a third engagement hole is defined in a side wall of the second slot;

the bathroom stool further comprises an auxiliary support member, wherein the auxiliary support member comprises an armrest and/or a backrest; and the auxiliary support member has a bracket free end extending along a horizontal direction at a bottom of the auxiliary support member, wherein a through hole is defined in a side wall of the bracket free end, and a third compression elastic tab is arranged inside the bracket free end, a third protrusion is securely arranged on a side of the third compression elastic tab, the third protrusion protruding, from the third through hole, out of the side wall of the bracket free end;

wherein engagement between the third protrusion and the third engagement hole is consistent with engagement between the first protrusion and the first engagement hole.

2. The bathroom stool according to claim 1, wherein the first compression elastic tab is bent to form a first segment and a second segment that define an angle therebetween, wherein a free end of the first segment and a free end of the second segment are respectively abutted against two opposite sides of the at least one support leg, and the first protrusion is securely arranged on a side of the first segment facing away from the second segment;

wherein the first segment is configured to be further bent in response to the first protrusion being pressed by the inner wall of the first slot, wherein an angle between the first segment and the second segment decreases.

3. The bathroom stool according to claim 1, wherein a guide inclined surface is arranged at a position on the inner wall of the first slot corresponding to the at least one support leg at an opening and under the first engagement hole, wherein a wall thickness of the first slot at the guide inclined surface progressively increases inward from the opening, and the guide inclined surface is configured to progressively increase a force applied to the first protrusion in the course of inserting the support leg into the first slot.

4. The bathroom stool according to claim 1, wherein a press portion is extended along a depth direction on an inner side wall of the first slot corresponding to the at least one support leg, wherein the press portion is configured to clamp the top end of the support leg after the support leg is inserted into the first slot.

5. The bathroom stool according to claim 1, wherein a plurality of second engagement holes are defined in the sleeve along an extension direction thereof; and a second through hole is defined in the side wall of the telescopic rod, and a second compression elastic tab is arranged inside the telescopic rod, wherein a second protrusion is securely arranged on a side of the second compression elastic tab, the second protrusion protruding, from the second through hole, out of the side wall of the telescopic rod;

wherein engagement between the second protrusion and each of the plurality of second engagement holes is consistent with engagement between the first protrusion and the first engagement hole.

6. The bathroom stool according to claim 1, wherein a connection plate is extended downward from an edge of the seat board, wherein an inverted triangular catch block is arranged on an inner wall of the connection plate; and the bathroom stool further comprises an item accommodation rack, wherein a hook is arranged on a side of the item accommodation rack, and the hook extends from a bottom of the connection plate to engage with the inverted triangular catch block, such that the item accommodation rack and the hook are engaged to be clamped and secured to the connection plate.

7. The bathroom stool according to claim 1, further comprising: a reinforcement bracket, wherein the reinforcement bracket is detachably connected between the plurality of support legs.

8. The bathroom stool according to claim 7, wherein the reinforcement bracket comprises a plurality of reinforcement rods, wherein each of the plurality of reinforcement rods is connected between two support legs of the plurality of support legs, and the plurality of reinforcement rods are intersected with each other and are detachably connected at an intersection.

9. The bathroom stool according to claim 1, wherein the seat board comprises a seat board body and a cushion, wherein a connection hole is defined in the seat board body, and a connection post is arranged on the cushion, the connection post being insertable into the connection hole.

* * * * *